US010450828B2

(12) United States Patent
Yu et al.

(10) Patent No.: US 10,450,828 B2
(45) Date of Patent: Oct. 22, 2019

(54) HIGH TEMPERATURE HIGH EXTRUSION RESISTANT PACKER

(71) Applicants: Chengjiao Yu, Houston, TX (US); Zhiyue Xu, Cypress, TX (US); Goang-Ding Shyu, Houston, TX (US); Carlos A. Prieto, Katy, TX (US)

(72) Inventors: Chengjiao Yu, Houston, TX (US); Zhiyue Xu, Cypress, TX (US); Goang-Ding Shyu, Houston, TX (US); Carlos A. Prieto, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 230 days.

(21) Appl. No.: 15/337,248

(22) Filed: Oct. 28, 2016

(65) Prior Publication Data

US 2018/0119510 A1 May 3, 2018

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC .... E21B 33/12; E21B 33/1208; E21B 33/128; B22D 19/02
See application file for complete search history.

(56) References Cited

U.S. PATENT DOCUMENTS

| | | | |
|---|---|---|---|
| 2,138,787 | A | 11/1938 | Gottschalk et al. |
| 2,240,185 | A | 4/1941 | Hennessy |
| 2,439,424 | A | 4/1948 | Goodloe et al. |
| 2,450,280 | A | 9/1948 | Homon |
| 3,864,124 | A | 2/1975 | Breton et al. |
| 5,660,917 | A | 8/1997 | Fujimori et al. |
| 5,861,203 | A | 1/1999 | Yuan et al. |
| 6,098,989 | A | 8/2000 | Caplain et al. |
| 6,352,264 | B1 | 3/2002 | Dalzell, Jr. et al. |
| 8,197,930 | B1 | 6/2012 | Jacobson et al. |
| 8,230,913 | B2 | 7/2012 | Hart et al. |
| 8,320,727 | B1 | 11/2012 | Jacobsen et al. |
| 8,354,170 | B1 | 1/2013 | Henry et al. |
| 9,527,261 | B1 | 12/2016 | Roper et al. |
| 9,726,300 | B2 | 8/2017 | Zhao et al. |
| 2004/0146736 | A1 | 7/2004 | Ivanov et al. |

(Continued)

FOREIGN PATENT DOCUMENTS

| | | | |
|---|---|---|---|
| CN | 1382577 | A | 12/2002 |
| CN | 1480276 | A | 3/2004 |

(Continued)

OTHER PUBLICATIONS

Courtois et al., "Mechanical Properties of Monofilament Entangled Materials", Advanced Engineering Materials, vol. 14, No. 12, 2012, pp. 1128-1133 (6 pp.).

(Continued)

*Primary Examiner* — Michael R Wills, III
(74) *Attorney, Agent, or Firm* — Cantor Colburn LLP

(57) ABSTRACT

A packer includes a body formed from an elastic composite material having one of a one-dimensional elastic structure, a periodic elastic structure, and a random elastic structure and a filler material.

20 Claims, 9 Drawing Sheets

(56) References Cited

U.S. PATENT DOCUMENTS

| | | | | |
|---|---|---|---|---|
| 2005/0039992 | A1 | 2/2005 | Hurwic | |
| 2005/0109502 | A1 | 5/2005 | Slay et al. | |
| 2006/0080835 | A1 | 4/2006 | Kooistra et al. | |
| 2011/0079962 | A1 | 4/2011 | Munro et al. | |
| 2011/0176757 | A1 | 7/2011 | Heldmann et al. | |
| 2011/0193217 | A1 | 8/2011 | Meyer-Berg | |
| 2012/0031616 | A1 | 2/2012 | Hall | |
| 2013/0228099 | A1 | 9/2013 | Soba et al. | |
| 2013/0300066 | A1 | 11/2013 | Xu et al. | |
| 2016/0046095 | A1 | 2/2016 | Clough et al. | |
| 2016/0069141 | A1 | 3/2016 | Blackmon | |
| 2016/0145961 | A1* | 5/2016 | Yu | B29C 44/1276 166/179 |
| 2016/0288200 | A1* | 10/2016 | Xu | C22C 49/14 |
| 2017/0144331 | A1 | 5/2017 | Yu et al. | |

FOREIGN PATENT DOCUMENTS

| | | | |
|---|---|---|---|
| CN | 101285135 | A | 10/2008 |
| CN | 101286714 | A | 10/2008 |
| CN | 201613676 | U | 10/2010 |
| CN | 102433010 | A | 5/2012 |
| CN | 102598892 | A | 7/2012 |
| CN | 103937224 | A | 7/2014 |
| CN | 103962479 | A | 8/2014 |
| CN | 104325652 | A | 2/2015 |
| EP | 1607653 | A1 | 12/2005 |
| RU | 2011460 | C1 | 4/1994 |
| RU | 2195381 | C2 | 12/2002 |
| RU | 2199413 | C1 | 2/2003 |
| RU | 2208496 | C1 | 7/2003 |
| SU | 1163951 | A | 6/1985 |
| SU | 1210944 | A1 | 2/1986 |
| SU | 1785474 | A3 | 12/1992 |

OTHER PUBLICATIONS

Tan et al. "3D entangled wire reinforced metallic composites", Materials Science and Engineering A 546, (2012) pp. 233-238 (6 pp.).

Vesenjak, et al., "Characterization of irregular open-cell cellular structure with silicone pore filler", Polymer Testing 32 (2013) pp. 1538-1544 (7 pp.).

Klar. "Powder Metallurgy" Metals Handbook, Desk Edition (2nd Edition). ASM Handbook. 1998. pp. 876-891 (Year: 1998).

* cited by examiner

HIGH TEMPERATURE HIGH EXTRUSION RESISTANT PACKER

BACKGROUND

Resource exploration systems employ a system of tubulars that extend from a surface downhole into a formation. The tubulars often packers that may be deployed to separate a well bore into multiple zones. Packers are typically made of an elastomeric material that may be selectively expanded to engage the well bore. Packers may be expanded using a variety of techniques including the use of tools extended downhole, or through other mechanisms including downhole actuators. Deployment of current packer designs is limited to downhole conditions that do not exceed 450° F. (232° C.). Above 450° F. packers tend to break down as the elastomeric material tends to degrade.

SUMMARY

A packer includes a body formed from an elastic composite material having one of a one-dimensional elastic structure, a periodic elastic structure, and a random elastic structure and a filler material.

A resource exploration/recovery system includes a surface portion, and a downhole portion including a plurality of tubulars. At least one of the plurality of tubulars includes a packer comprising a body formed from an elastic composite material having one of a one-dimensional elastic structure, a periodic elastic structure, and a random elastic structure.

A method of segregating a borehole into multiple zones includes running a plurality of tubulars into the borehole, and deploying a packer including a body formed from an elastic composite material having one of a one-dimensional elastic structure, a periodic elastic structure, and a random elastic structure supported by one of the plurality of tubulars.

BRIEF DESCRIPTION OF THE DRAWINGS

Referring now to the drawings wherein like elements are numbered alike in the several Figures:

in FIG. 4B, the filler is in the form of a powder; and in FIG. 4C, the filler comprises pellets;

DETAILED DESCRIPTION

Figure 1:
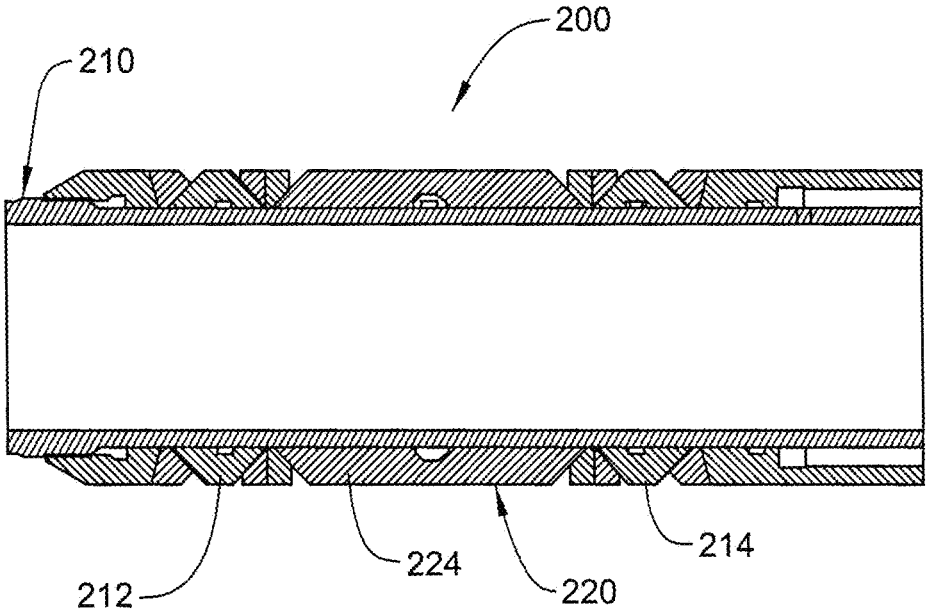
FIG. 1 depicts a tubular including a packer formed from a composite material having an elastic structure with filler material, in accordance with an exemplary embodiment.
Figure 12:
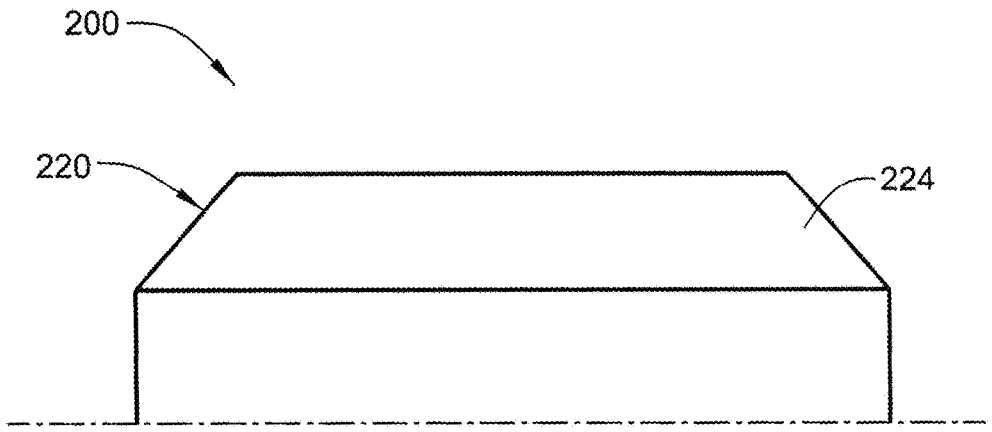
FIG. 12 depicts a packer formed from a material having an elastic structure, in accordance with an aspect of an exemplary embodiment.

A packer, formed in accordance with an exemplary embodiment, is illustrated generally at 200 in FIG. 1. Packer 200 is supported by a tubular 210 between a first wedge ring 212 and a second wedge ring 214. It is to be understood that the particular type of wedge ring may vary. It is to be further understood that additional rings, such as edge c-rings and grooved C-rings, may also be employed. As shown in FIG. 12, Packer 200 includes a body 220 formed from an elastic composite material 224 having an elastic structure with filler materials as described below. The elastic structure may take the form of a one-dimensional elastic structure, a periodic elastic structure such as described in U.S. patent application Ser. No. 14/548,610, entitled "PERIODIC STRUCTURED COMPOSITE AND ARTICLES THEREFROM", filed on Nov. 20, 2014, incorporated herein by reference in its entirety, or a random elastic structure such as described in U.S. patent application Ser. No. 14/676,864, entitled "ULTRAHIGH TEMPERATURE ELASTIC METAL COMPOSITES", filed on Apr. 2, 2015, also incorporated herein by reference in its entirety.

It is to be understood that the phrase "elastic structure" means that the structure has greater than about 50% elastic deformation, greater than about 80% elastic deformation, greater than about 100% elastic deformation, or greater than about 200% of elastic deformation. A percentage of elastic deformation can be calculated by $\Delta L/L$, where $\Delta L$ is the recoverable change in a dimension as a result of a tensile or compressive stress, and L is the original dimension length. As used herein, the phrase "one-dimensional structure" refers to a structure that can extend continuously in one direction.

The elastic structure may comprise a porous matrix material and can be formed from a wire. The wire can have a diameter of about 0.08 to about 0.5 mm. The cross-section of the wire is not particularly limited. Exemplary cross-sections include circle, triangle, rectangle, square, oval, star and the like. The wire can be hollow.

Figure 2A:
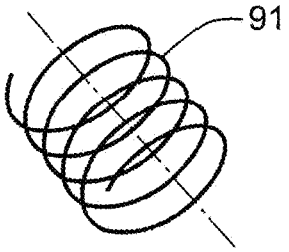
FIGS. 2A-2C illustrate unfilled one-dimensional elastic structures according to some embodiments of the disclosure, wherein in FIGS. 2A-2C the elastic structures comprise coils having a shape of circle, square, and triangle respectively.
Figure 2B:
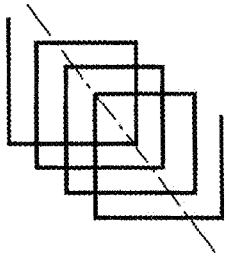
Figure 2C:
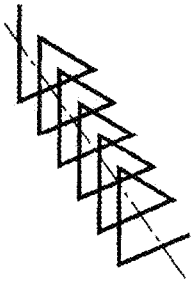
Figure 3A:
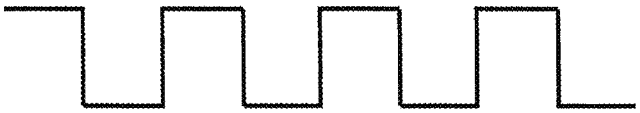
FIGS. 3A-3C illustrate exemplary unfilled one-dimensional elastic structures according to other embodiments of the disclosure.
Figure 3B:
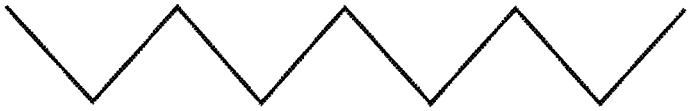
Figure 3C:
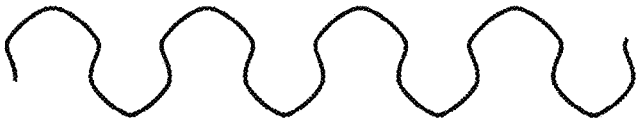

The patterns of the one-dimensional elastic structure are not particularly limited as long as they provide the desired elasticity. Exemplary patterns include springs as shown in FIGS. 2A-2C. The shapes of the coils of the springs are not particularly limited. In FIGS. 2A-2C the coils of the springs have a shape of circle, square, and triangle respectively. Other shapes are contemplated. The pattern can also have a planar structure as illustrated in FIGS. 3A-3C.

In a specific embodiment, the elastic composite material comprises a one-dimensional elastic structure such as a spring. The spring can have an average spring pitch of about 10 to about 15 times of the wire diameter, where the pitch of a spring refers to the distance from the center of one coil to the center of the adjacent coil. The average spring diameter is also about 10 to about 15 times of the wire diameter. As used herein, spring diameter refers to the outside diameter of the coil minus one wire diameter (d). Such a spring diameter is also commonly known as mean coil diameter. In an embodiment, the springs have an average spring pitch of about 0.8 to about 7.5 mm and an average spring diameter of about 0.8 to about 7.5 mm. The springs can have a density of about 0.2 to about 4 g/cm$^3$. In an exemplary embodiment, the springs are hollow members that have a wall thickness ranging from tens of nanometers to tens of microns (10 nanometers to 90 microns). In certain embodiments, the springs are solid members. The springs may be formed from a wire comprising stainless-steel.

Figure 4A:
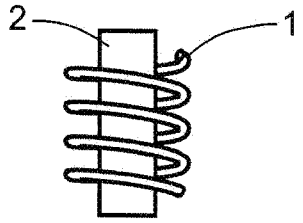
FIGS. 4A-4C illustrate filler filled one-dimensional elastic structures according to various embodiments of the disclosure wherein in FIG. 4A the structure comprises a spring wound around a filler rod.
Figure 4B:
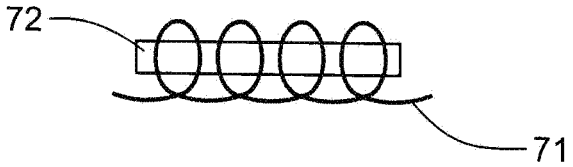
Figure 4C:
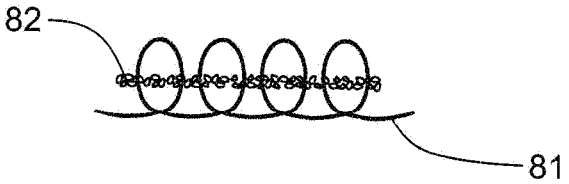

The form and shape of the fillers are not particularly limited. The fillers can comprise a solid piece in the form of a tube, a rod, or the like. The fillers can also be in the form of a coating, a powder or pellets. FIGS. 4A-4C illustrate filler filled one-dimensional elastic structures according to various embodiments of the disclosure. In FIG. 4A the filled one-dimensional elastic structure comprises a spring 1 wound around a filler rod 2; in FIG. 4B, the filler 72 is in the form of a powder disposed inside the coils of a spring 71; and in FIG. 4C, the filler 82 comprises pellets disclosed inside the coils of a spring 81.

In an embodiment, the one-dimensional elastic structure at least partially encompasses the filler. For example, the filler can occupy the entire open space inside the coils of the springs or occupy a portion of the open space insider the coils of the springs. The filler can be in partial, full, or no contact with the one-dimensional elastic structure. In another embodiment, the filler is coated on the one-dimensional elastic structure.

Figure 5:
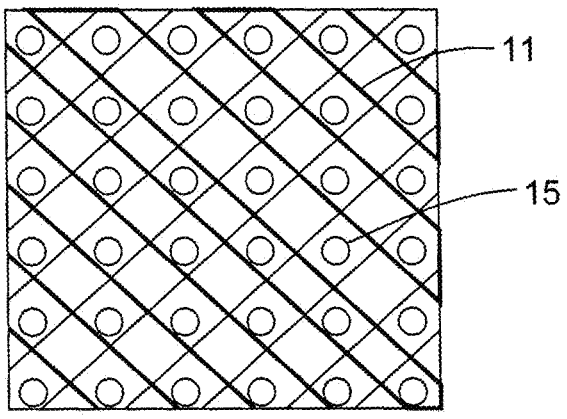
FIG. 5 illustrates a method of preparing a sheet according to an aspect of an exemplary embodiment of the disclosure.
Figure 6:
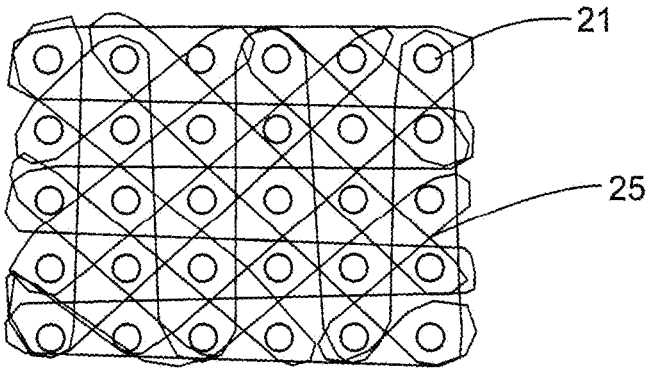
FIG. 6 illustrates a method of preparing a sheet according to another aspect of an exemplary embodiment of the disclosure.

The one-dimensional elastic structure can be used to form a sheet. The method is not particularly limited and includes bending, stacking, aligning, knotting the one-dimensional elastic structures, or a combination comprising at least one of the foregoing. FIG. 5 illustrates a method of preparing a sheet according to an embodiment of the disclosure; and FIG. 6 illustrates a method of preparing a sheet according to another embodiment of the disclosure. In FIG. 5, one-dimensional elastic structure 11 is wound around pin 15 according to a preset pattern to form a sheet having a periodic elastic structure. In FIG. 6, a one-dimensional elastic structure 21 is wound around pin 25 according to another preset pattern to form a sheet having a periodic elastic structure. Pins can be removed after the sheets are formed. Similarly, a two-dimensional filled sheet (not shown) can be formed with one-dimensional elastic structures.

Similar to the composite orientation labeling, a standard orientation code can be used to define the orientations of the elastic structures. In the instant where the one-dimensional elastic structure comprises springs, the orientation code denotes the angle, in degrees, between the spring coil axial direction and the "X" axis of an article made from the elastic structure. The "X" axis of the article can be a randomly chosen reference axis. The springs may be orientated in any angles with respect to the X-axis)(0°).

Figure 7A:
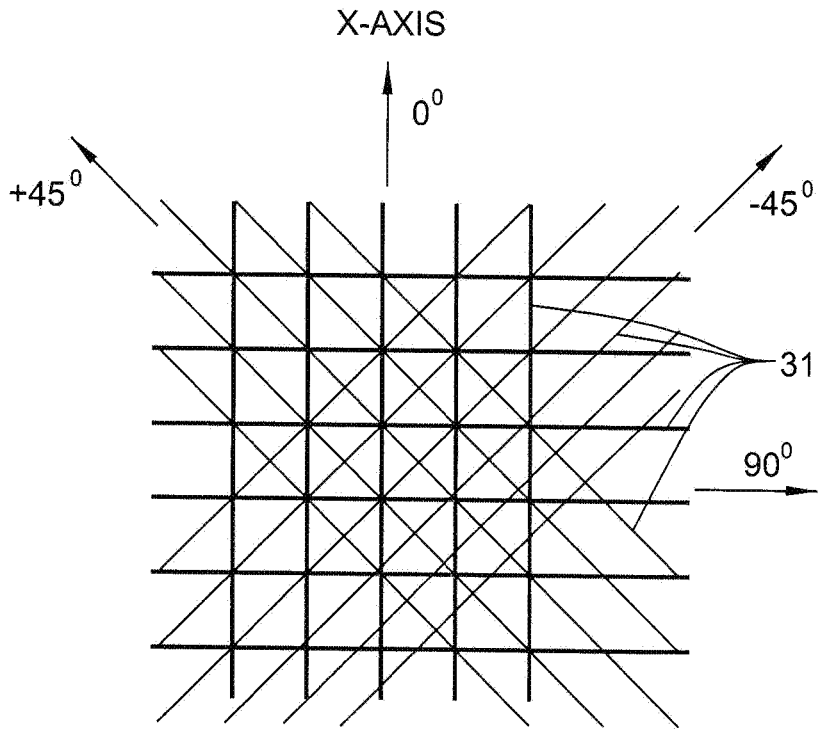
FIG. 7A illustrates the orientations of springs in a sheet at 0°, +45°, −45°, and 90°.
Figure 7B:
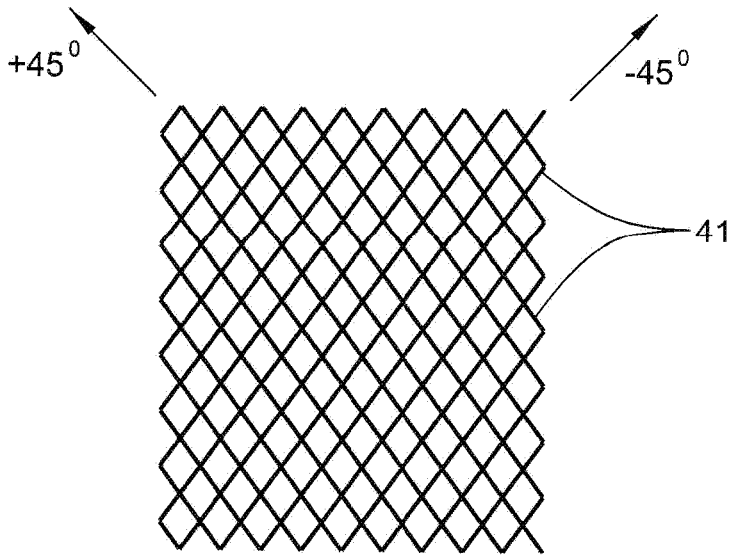
FIG. 7B illustrates the orientations of springs in a sheet at +45° and −45°.
Figure 7C:
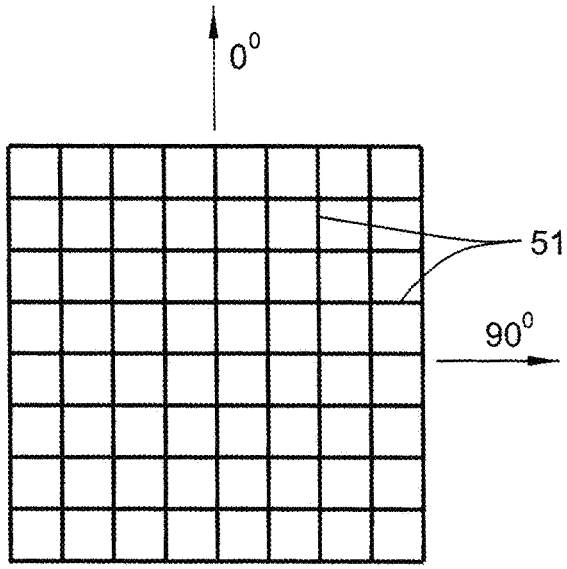
FIG. 7C illustrates the orientations of springs in a sheet at 0° and 90°.
Figure 7D:
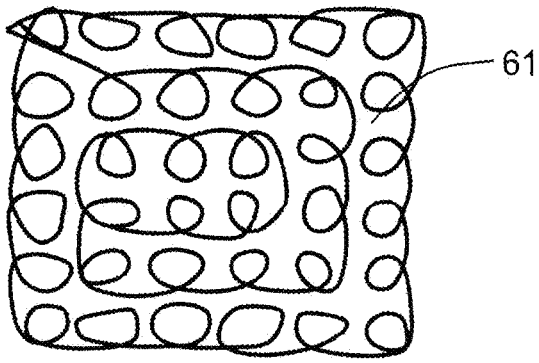
FIG. 7D illustrates random orientated springs in a sheet.

In an embodiment, the filler filled, or unfilled, one-dimensional spring in a given sheet is oriented in the same direction. In another embodiment, the one-dimensional spring in a given sheet is oriented in more than one direction. For example in FIGS. 7A, 7B and 7C, the spring orientations are denoted as [0, 90, +45, −45], [+45,−45], and [0, 90] respectively, where the orientations are separated by comma a (,). The plus (+) and minus (−) angles are relative to the "X" axis. Plus (+) signs are to the left of zero, and minus (−) signs are to the right of zero. In these figures, straight lines 31, 41, and 51 represent filler filled springs. The springs may also be laid in random directions within one sheet, as shown in FIG. 7D.

The sheets can be used to form the preform. Methods are not particularly limited and include bending, folding, or rolling the sheet, stacking multiple sheets together or a combination comprising at least one of the foregoing.

Figure 8A:
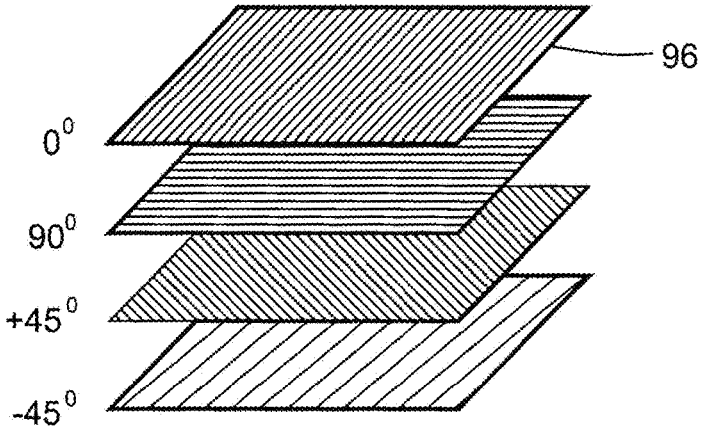
FIG. 8A illustrates multiple layers of sheets with a first layer having springs oriented at 0°, a second layer having springs oriented at 90°, a third layer having springs oriented at +45°, and a fourth layer having springs oriented at −45°.
Figure 8B:
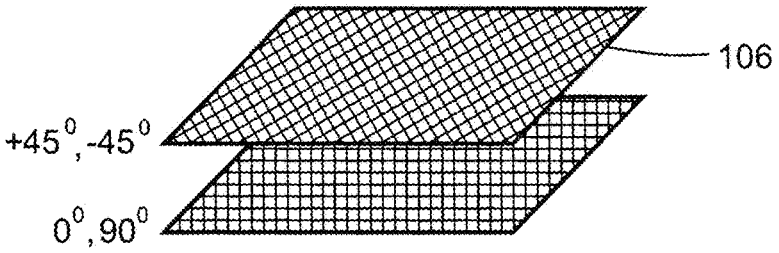
FIG. 8B illustrates multiple layers of sheets with a first layer having springs oriented at +45° and −45°; and a second layer having springs oriented at 0° and 90°.

When multiple sheets are stacked together, the one-dimensional elastic structures in each layer can have the same or different orientation profiles. FIG. 8A illustrates a preform containing four layers of filled sheets (96) containing springs orientated at 0° C., 90°, +45° and −45° respectively in each layer. FIG. 8B illustrates a preform containing two layers of filled sheets (106) where the top layer contains springs orientated at +45° and −45° and the bottom layer contains springs oriented at 0° and 90°. Similarly, multiple filler-filled sheets may be stacked together.

Figure 9A:
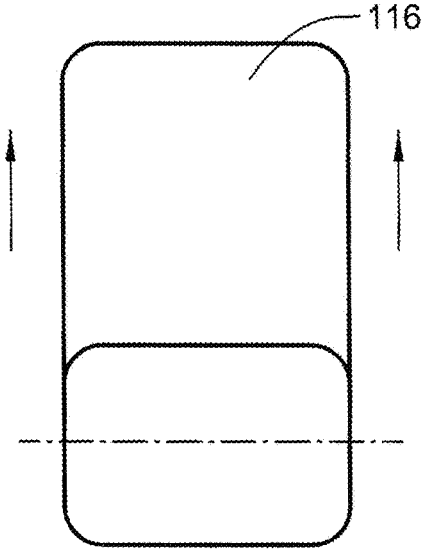
FIG. 9A illustrates a method of making a preform from a sheet according to an embodiment of the disclosure.
Figure 9B:
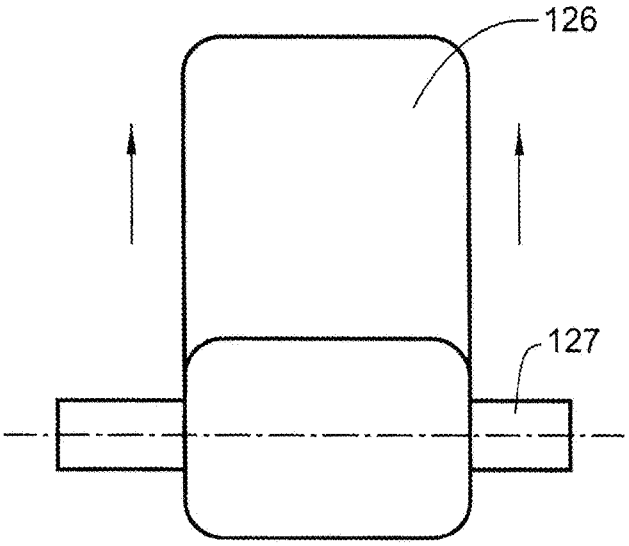
FIG. 9B illustrates a method of making a preform from a sheet according to another embodiment of the disclosure.

As shown in FIGS. 9A and 9B, the filled sheet 116 or 126 can be rolled along the arrow direction to form the preform, except that the method illustrated in FIG. 9A does not have a mandrel whereas the method illustrated in FIG. 9B uses a mandrel 127.

Although the preform can be formed from a sheet, which is in turn formed from a one-dimensional elastic structure, it is appreciated that the preform can be formed directly from the one-dimensional structure without forming a sheet first. The method is not particularly limited and includes bending, knotting, stacking the one-dimensional elastic structure and the like. Further, it should be understood that the preform can be formed from a filled sheet, which is in turn formed from a filler-filled one-dimensional elastic structure in a manner similar to that described above.

In another embodiment, a method of manufacturing an elastic composite comprises forming a preform comprising alternating layers of a matrix layer and a filler layer; the matrix layer comprising a periodic structure network formed from a matrix material; and the filler layer comprising a filler material; molding the preform to form a molded product; and sintering the molded product to provide the elastic composite.

The matrix layer can be formed from a filler filled one-dimensional elastic structure as described herein or an unfilled one-dimensional elastic structure, or a combination thereof. In an embodiment, the unfilled one-dimensional elastic structures can have the same average spring pitch, same average spring diameter, and same wire diameter as the springs described herein in the context of filler filled one-dimensional elastic structure. Methods to form the matrix layer are not particularly limited and includes bending, aligning, stacking, knotting the one-dimensional elastic structures, or a combination comprising at least one of the foregoing. Methods illustrated in FIGS. 5 and 6 can also be used to make matrix layers. In a specific embodiment, a periodic structure network may comprise periodic springs.

The orientations of the springs in one matrix layer as well as the orientations of springs in different matrix layers can be the same as described herein in the context of the filled sheets and the preforms made from filler filled one-dimensional elastic structures. The terms layers and sheets are used interchangeably herein.

Figure 10:
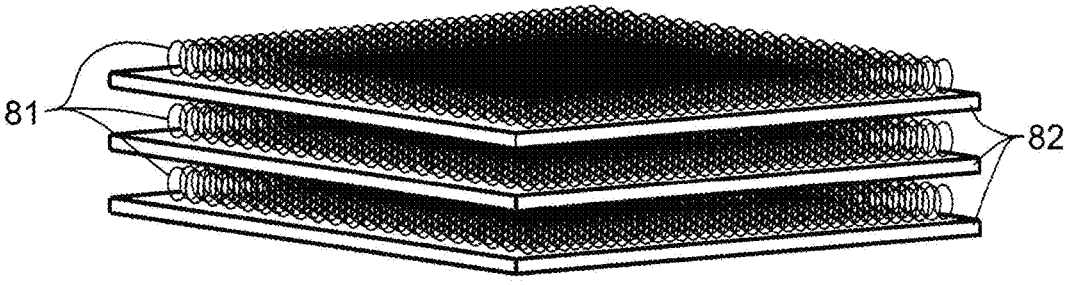
FIG. 10 illustrates a preform containing alternating layers of a matrix layer and a filler layer.

As used herein, alternating layers of a matrix layer and a filler layer comprise at least one matrix layer and at least one filler layer. One exemplary preform is illustrated in FIG. 10, which contains multiple matrix layers 81 and multiple filler layers 82. The preform can be used directly in the molding and sintering process. Alternatively the preform can be further rolled, folded, or bended before it is compressed and sintered. If desirable, additional filler can be impregnated into the preform.

In another embodiment, a method of manufacturing an elastic composite comprises forming a matrix layer from an unfilled one-dimensional elastic structure; bending; folding; rolling; or stacking the matrix layer; and combining the matrix layer with a filler material to form a preform. It is appreciated that the filler can be in the form of a powder, gel, liquid and the like. The filler can be combined with the matrix material before the matrix layer is further bended, folded, rolled, or stacked or after the matrix layer is bended, folded, rolled, or stacked. The combination method includes impregnation, infiltration, or other processes known in the art.

The preform can be compression molded, sintered, and/or hot isostatic pressed to form the elastic composite. In an embodiment, the method comprises molding the preform to provide a molded product; and sintering the molded product to form the elastic composite. Molding is conducted at a pressure of about 500 psi to about 50,000 psi and a molding temperature of about 20° C. to about 30° C. Sintering is carried out at a temperature greater than about 150° C. but lower than the melting points of the filler material and the matrix material. A pressure of about 500 psi to about 50,000 psi is optionally applied during the sintering process.

Optionally the method further comprises heating the elastic composite at an elevated temperature and atmospheric pressure to release residual stress. In an embodiment, the heating temperature is about 20 to 50° C. lower than the sintering temperature to make the elastic composite. In the instance where the filler is a polymer, the post treatment temperature is about 20° C. to about 300° C. or about 20° C. to about 200° C.

As used herein, a "matrix material" refers to a material that forms a pattern or structure providing elasticity to the composite. The matrix material comprises one or more of the following: a metal; a metal alloy; a carbide; a ceramic; or a polymer or combinations thereof. In an embodiment, the matrix material comprises a metal or a corrosion resistant metal alloy. Exemplary matrix material includes one or more of the following: an iron alloy, a nickel-chromium based alloy, a nickel alloy, copper, or a shape memory alloy. An iron alloy includes steel such as stainless steel. Nickel-chromium based alloys include INCONEL. Nickel-chromium based alloys can contain about 40-75% of Ni and about 10-35% of Cr. The nickel-chromium based alloys can also contain about 1 to about 15% of iron. Small amounts of Mo, Nb, Co, Mn, Cu, Al, Ti, Si, C, S, P, B, or a combination comprising at least one of the foregoing can also be included in the nickel-chromium based alloys. Nickel alloy includes HASTELLOY. Hastelloy is a trademarked name of Haynes International, Inc. As used herein, Hastelloy can be any of the highly corrosion-resistant superalloys having the "Hastelloy" trademark as a prefix. The primary element of the HASTELLOY group of alloys referred to in the disclosure is nickel; however, other alloying ingredients are added to nickel in each of the subcategories of this trademark designation and include varying percentages of the elements molybdenum, chromium, cobalt, iron, copper, manganese, titanium, zirconium, aluminum, carbon, and tungsten. Shape memory alloy is an alloy that "remembers" its original shape and that when deformed returns to its pre-deformed shape when heated. Exemplary shape memory alloys include Cu—Al—Ni based alloys, Ni—Ti based alloys, Zn—Cu—Au—Fe based alloys, and iron-based and copper-based shape memory alloys, such as Fe—Mn—Si, Cu—Zn—Al and Cu—Al—Ni.

Exemplary polymers for the matrix material include elastomers such as acrylonitrile butadiene rubber (NBR); hydrogenated nitrile butadiene (HNBR); acrylonitrile butadiene carboxy monomer (XNBR); ethylene propylene diene monomer (EPDM); fluorocarbon rubber (FKM); perfluorocarbon rubber (FFKM); tetrafluoro ethylene/propylene rubbers (FEPM); silicone rubber and polyurethane (PU); thermoplastics such as nylon, polyethylene (PE), polytetrafluoroethylene (PTFE); perfluoroalkoxy alkane (PFA), polyphenylene sulfide (PPS) polyether ether ketone (PEEK); polyphenylsulfone (PPSU); polyimide (PI), polyethylene tetraphthalate (PET) or polycarbonate (PC).

Exemplary carbides for the matrix material include a carbide of aluminum, titanium, nickel, tungsten, chromium, iron, an aluminum alloy, a copper alloy, a titanium alloy, a nickel alloy, a tungsten alloy, a chromium alloy, or an iron alloy, SiC, $B_4C$.

Advantageously, the filler materials may enhance the sealing characteristics of the elastic structures such as metal springs while providing additional strength and rigidity. The filler materials can have similar or complimentary elastic properties of the elastic structures such as metal springs. Optionally the filler material has a high temperature rating. The filler materials in the elastic composites comprise a carbon composite; a polymer; a metal; graphite; cotton; asbestos; or glass fibers. Although there may be overlaps between the materials that can be used as a filler and a matrix material, it is appreciated that in a given elastic composite, the filler and the matrix material are compositionally different. Combinations of the materials can be used. The filler material can be a sintered material or a non-sintered material. Optionally the filler materials contain reinforcement fibers, the reinforcement fibers being oriented in short, long, or continuous fibers, beads, or balloons. The volume ratio between the filler material and the metal matrix can vary depending on the applications. In an embodiment, the volume ratio of the matrix material relative to the filler material is about 2.5%:97.5% to about 80%:20%, about 5%:95% to about 70%:30%, or about 10%:90% to about 60%:40%.

When the filler material is a carbon composite, the elastic composite can have a temperature rating of greater than about 600° C. Carbon composites contain carbon and an inorganic binder. The carbon can be graphite such as natural graphite; synthetic graphite; expandable graphite; or expanded graphite; or a combination comprising at least one of the foregoing.

In an embodiment, the carbon composites comprise carbon microstructures having interstitial spaces among the carbon microstructures; wherein the binder is disposed in at least some of the interstitial spaces. The interstitial spaces among the carbon microstructures have a size of about 0.1 to about 100 microns, specifically about 1 to about 20 microns. A binder can occupy about 10% to about 90% of the interstitial spaces among the carbon microstructures.

The carbon microstructures can also comprise voids within the carbon microstructures. The voids within the carbon microstructures are generally between about 20 nanometers to about 1 micron, specifically about 200 nanometers to about 1 micron. As used herein, the size of the voids or interstitial spaces refers to the largest dimension of the voids or interstitial spaces and can be determined by high resolution electron or atomic force microscope technology. In an embodiment, to achieve high strength, the voids within the carbon microstructures are filled with the binder or a derivative thereof. Methods to fill the voids within the carbon microstructures include vapor deposition.

The carbon microstructures are microscopic structures of graphite formed after compressing graphite into highly condensed state. They comprise graphite basal planes stacked together along the compression direction. As used herein, carbon basal planes refer to substantially flat, parallel sheets or layers of carbon atoms, where each sheet or layer has a single atom thickness. The graphite basal planes are also referred to as carbon layers. The carbon microstructures are generally flat and thin. They can have different shapes and can also be referred to as micro-flakes, micro-discs and the like. In an embodiment, the carbon microstructures are substantially parallel to each other.

The carbon microstructures have a thickness of about 1 to about 200 microns, about 1 to about 150 microns, about 1 to about 100 microns, about 1 to about 50 microns, or about 10 to about 20 microns. The diameter or largest dimension of the carbon microstructures is about 5 to about 500 microns or about 10 to about 500 microns. The aspect ratio of the carbon microstructures can be about 10 to about 500, about 20 to about 400, or about 25 to about 350. In an embodiment, the distance between the carbon layers in the carbon microstructures is about 0.3 nanometers to about 1 micron. The carbon microstructures can have a density of about 0.5 to about 3 $g/cm^3$, or about 0.1 to about 2 $g/cm^3$.

In the carbon composites, the carbon microstructures are held together by a binding phase. The binding phase comprises a binder that binds carbon microstructures by mechanical interlocking. Optionally, an interface layer is formed between the binder and the carbon microstructures. The interface layer can comprise chemical bonds, solid solutions, or a combination thereof. When present, the chemical bonds, solid solutions, or a combination thereof may strengthen the interlocking of the carbon microstructures. It is appreciated that the carbon microstructures may be held together by both mechanical interlocking and chemical bonding. For example the chemical bonding, solid solution, or a combination thereof may be formed between some carbon microstructures and the binder or for a particular carbon microstructure only between a portion of the carbon on the surface of the carbon microstructure and the binder. For the carbon microstructures or portions of the carbon microstructures that do not form a chemical bond, solid solution, or a combination thereof, the carbon microstructures can be bounded by mechanical interlocking. The thickness of the binding phase is about 0.1 to about 100 microns or about 1 to about 20 microns. The binding phase can form a continuous or discontinuous network that binds carbon microstructures together.

Exemplary binders include a nonmetal, a metal, an alloy, or a combination comprising at least one of the foregoing. The nonmetal is one or more of the following: $SiO_2$; Si; B; or $B_2O_3$. The metal can be at least one of aluminum; copper; titanium; nickel; tungsten; chromium; iron; manganese; zirconium; hafnium; vanadium; niobium; molybdenum; tin; bismuth; antimony; lead; cadmium; or selenium. The alloy includes one or more of the following: aluminum alloys; copper alloys; titanium alloys; nickel alloys; tungsten alloys; chromium alloys; iron alloys; manganese alloys; zirconium alloys; hafnium alloys; vanadium alloys; niobium alloys; molybdenum alloys; tin alloys; bismuth alloys; antimony alloys; lead alloys; cadmium alloys; or selenium alloys. In an embodiment, the binder comprises one or more of the following: copper; nickel; chromium; iron; titanium; an alloy of copper; an alloy of nickel; an alloy of chromium; an alloy of iron; or an alloy of titanium. Exemplary alloys include steel, nickel-chromium based alloys such as Inconel*, and nickel-copper based alloys such as Monel alloys. Nickel-chromium based alloys can contain about 40-75% of Ni and about 10-35% of Cr. The nickel-chromium based alloys can also contain about 1 to about 15% of iron. Small amounts of Mo, Nb, Co, Mn, Cu, Al, Ti, Si, C, S, P, B, or a combination comprising at least one of the foregoing can also be included in the nickel-chromium based alloys. Nickel-copper based alloys are primarily composed of nickel (up to about 67%) and copper. The nickel-copper based alloys can also contain small amounts of iron, manganese, carbon, and silicon. These materials can be in different shapes, such as particles, fibers, and wires. Combinations of the materials can be used.

The binder used to make the carbon composite is micro- or nano-sized. In an embodiment, the binder has an average particle size of about 0.05 to about 250 microns, about 0.05 to about 100 microns, about 0.05 to about 50 microns, or about 0.05 to about 10 microns. Without wishing to be bound by theory, it is believed that when the binder has a size within these ranges, it disperses uniformly among the carbon microstructures.

When an interface layer is present, the binding phase comprises a binder layer comprising a binder and an interface layer bonding one of the at least two carbon microstructures to the binder layer. In an embodiment, the binding phase comprises a binder layer, a first interface layer bonding one of the carbon microstructures to the binder layer, and a second interface layer bonding the other of the at least two microstructures to the binder layer. The first interface layer and the second interface layer can have the same or different compositions.

The interface layer comprises one or more of the following: a C-metal bond; a C—B bond; a C—Si bond; a C—O—Si bond; a C—O-metal bond; or a metal carbon solution. The bonds are formed from the carbon on the surface of the carbon microstructures and the binder.

In an embodiment, the interface layer comprises carbides of the binder. The carbides include one or more of the following: carbides of aluminum; carbides of titanium; carbides of nickel; carbides of tungsten; carbides of chromium; carbides of iron; carbides of manganese; carbides of zirconium; carbides of hafnium; carbides of vanadium; carbides of niobium; or carbides of molybdenum. These carbides are formed by reacting the corresponding metal or metal alloy binder with the carbon atoms of the carbon microstructures. The binding phase can also comprise SiC formed by reacting $SiO_2$ or Si with the carbon of carbon microstructures, or $B_4C$ formed by reacting B or $B_2O_3$ with the carbon of the carbon microstructures. When a combination of binder materials is used, the interface layer can comprise a combination of these carbides. The carbides can be salt-like carbides such as aluminum carbide, covalent carbides such as SiC and $B_4C$, interstitial carbides such as carbides of the group 4, 5, and 6 transition metals, or intermediate transition metal carbides, for example the carbides of Cr, Mn, Fe, Co, and Ni.

In another embodiment, the interface layer comprises a solid solution of carbon such as graphite and a binder. Carbon has solubility in certain metal matrix or at certain temperature ranges, which can facilitate both wetting and binding of a metal phase onto the carbon microstructures. Through heat-treatment, high solubility of carbon in metal can be maintained at low temperatures. These metals include one or more of Co; Fe; La; Mn; Ni; or Cu. The binder layer can also comprise a combination of solid solutions and carbides.

The carbon composites comprise about 20 to about 95 wt. %, about 20 to about 80 wt. %, or about 50 to about 80 wt. % of carbon, based on the total weight of the composites. The binder is present in an amount of about 5 wt. % to about 75 wt. % or about 20 wt. % to about 50 wt. %, based on the total weight of the composites. In the carbon composites, the weight ratio of carbon relative to the binder is about 1:4 to about 20:1, or about 1:4 to about 4:1, or about 1:1 to about 4:1.

The carbon composites can optionally comprise a reinforcing agent. Exemplary reinforcing agent includes one or more of the following: carbon fibers; carbon black; mica; clay; glass fibers; ceramic fibers; or ceramic hollow structures. Ceramic materials include SiC, $Si_3N_4$, $SiO_2$, BN, and the like. The reinforcing agent can be present in an amount of about 0.5 to about 10 wt. % or about 1 to about 8%, based on the total weight of the carbon composite.

Filler materials other than carbon composites can also be used in the elastic composites of the disclosure. Other suitable filler materials for the elastic composites include a soft metal, soft metal alloy, or a combination comprising one or more of the foregoing. Exemplary metals for the filler material include one or more of the following: aluminum; copper; lead; bismuth; gallium; cadmium; silver; gold; rhodium; thallium; tin; alloys thereof; or a eutectic alloy. A eutectic alloy is one for which the melting point is as low as possible and all the constituents of the alloy crystallize simultaneously at this temperature from the liquid state.

The filler materials for the elastic composites can also be a polymer such as a thermosetting polymer, a thermoplastic polymer or a combination comprising at least one of the foregoing. As used herein, polymers include both synthetic polymers and natural polymers. Polymers also include crosslinked polymers. When the filler material is a polymer, the elastic composite can have a recoverable deformation of greater than about 30%.

Exemplary polymers for the filler material include elastomers such as acrylonitrile butadiene rubber (NBR); hydrogenated nitrile butadiene (HNBR); acrylonitrile butadiene carboxy monomer (XNBR); ethylene propylene diene monomer (EPDM); fluorocarbon rubber (FKM); perfluorocarbon rubber (FFKM); tetrafluoro ethylene/propylene rubbers (FEPM); silicone rubber and polyurethane (PU); thermoplastics such as nylon, polyethylene (PE), polytetrafluoroethylene (PTFE); perfluoroalkoxy alkane (PFA), polyphenylene sulfide (PPS) polyether ether ketone (PEEK); polyphenylsulfone (PPSU); polyimide (PI), polyethylene tetraphthalate (PET) or polycarbonate (PC). In a specific embodiment, the filler comprises polytetrafluoroethylene.

The filler materials are bounded to the matrix materials/structures via mechanical interlocking; or chemical bonding; either directly or through an active interface layer between the surfaces of the matrix materials/structures and the filler materials. As used herein, the term "matrix structures" refer to the structures formed from the matrix materials. The binding between matrix materials/structures and filler materials facilitates transferring loads between the matrix and the filler. Advantageously, optimum binding allows for compatibility and integrity of the different materials of matrix and the filler under loading conditions. Weak interfacial bounding may not be sufficient for load distribution and transformation as delamination or cracks may occur and destroy the integrity of the composite, while excessive interfacial bounding may lead to a rigid composite, which compromises the elasticity of the matrix.

When the filler materials comprise a carbon composite or a metal, the filler materials can be bounded to the matrix materials/structures via at least one of a solid solution or intermetallic compounds formed between the metal in the matrix material and the metal in the filler material. Advantageously, a solid solution is formed providing robust binding between the filler material and the matrix material. When the filler materials comprise a polymer, the filler materials can be bounded to the matrix material/structure through mechanical interlocking.

Figure 11:
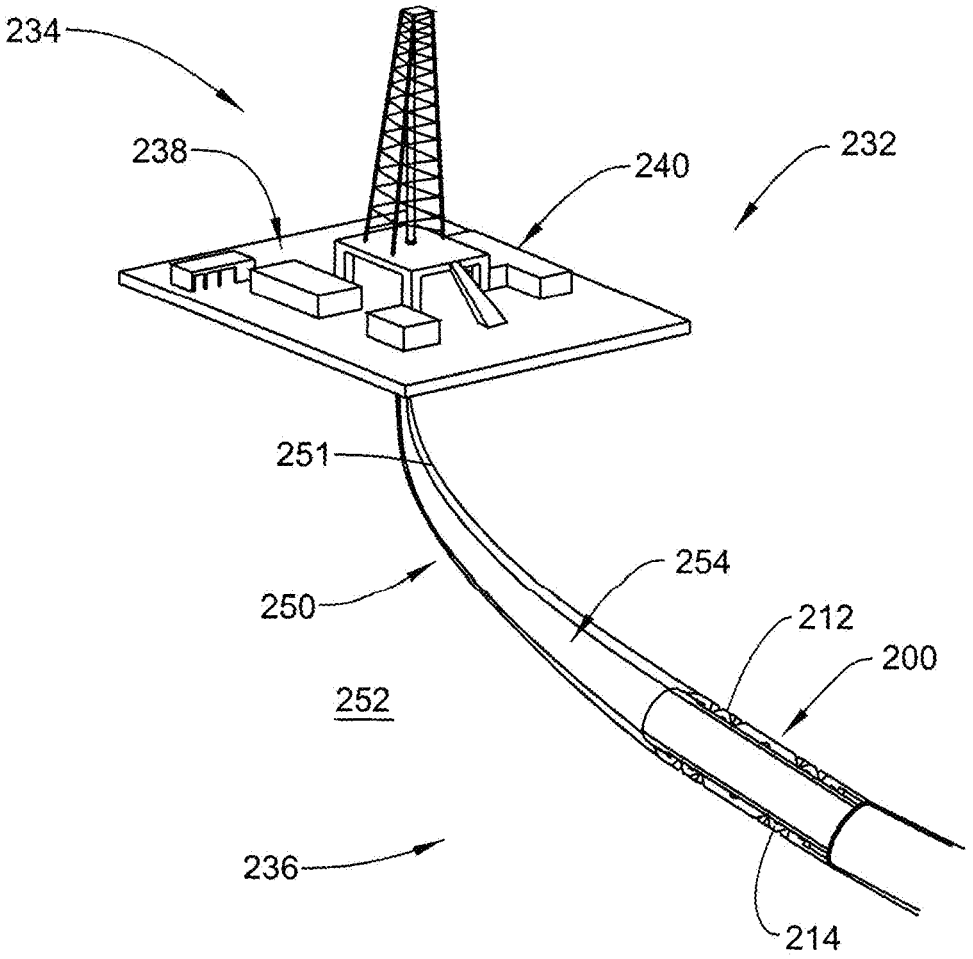
FIG. 11 depicts a resource exploration system including the packer formed from a material having an elastic structure, in accordance with an exemplary embodiment

The elastic composites are useful for preparing articles for a wide variety of applications. The elastic composites may be used to form all or a portion of an article such as packer 200. Packer 200 may form part of a resource exploration system, in accordance with an exemplary embodiment, is indicated generally at 232, in FIG. 11. Resource exploration system 232 should be understood to include well drilling operations, resource extraction and recovery, $CO_2$ sequestration, and the like. Resource exploration system 232 may include a surface system 234 operatively connected to a downhole system 236. Surface system 234 may include pumps 238 that aid in completion and/or extraction processes as well as fluid storage 240. Fluid storage 240 may contain a gravel pack fluid or slurry (not shown) that is introduced into downhole system 236.

Downhole system 236 may include a plurality of tubulars 250 that are extended into a borehole 251 formed in formation 252. While borehole 251 is shown as an open hole, it is to be understood that packer 200 may be deployable in cased boreholes. Plurality of tubulars 250 may be formed from a number of connected downhole tools or tubulars 254 that include tubular 210. In accordance with an exemplary aspect, packer 200 may be deployed to segregate borehole into multiple zones. Packer 200 may be deployed downhole in high temperature applications. The term "high temperature" should be understood to describe temperatures that exceed 450° F. (232° C.). For example, packer 200 may be deployable in conditions where downhole temperatures exceed 500° F. (260° C.). That is, the exemplary embodiments describe a packer having an elastic structure that is capable of high temperature/high pressure deployment.

Packer 200 formed from an elastic composite material 224 possesses high extrusion resistance and thus is capable of holding or supporting pressures up to about 2000 psi (13.78) and greater. For example, in addition to being deployable in high temperature conditions, packer 200 supports pressures of at least 2000 psi when exposed to high temperature conditions. Elastic composite material 224 may include one of a one-dimensional elastic structure, a periodic elastic structure, and a random elastic structure. The elastic composite employed to form material 224 also possesses high expansion capabilities.

For example, packer 200 may expand to 6.79-inch (17.25-cm) when formed with a 0.65-inch (16.51-mm) thickness and a 5.75-inch (14.6-cm) OD. Elastic composite material 224 also provides increased corrosion resistance resulting from included corrosion resistant filler material and springs that may be formed from stainless steel. It is to be understood that packer 200 may be formed through a variety of processes including molding, extrusion, and the like. Further, it is to be understood that packer 200 may be formed of a plurality of packer segments (not shown). These segments may be the same or different in terms of filler materials, elastic structures, dimensions (thickness) or shapes, densities, etc. according to the desired applications.

In further accordance with an exemplary embodiment, elastic composite material 224 possess enhanced extrusion resistance. For example, a compressive load of up to 30,000 lbf (13.7 tf) applied to extrude elastic composite material 224 through a 0.0030-inch (0.0762-mm) gap at a temperature of 550° F. (287.8° C.) resulted in a displacement of less than 0.2-inches (5.1 mm)

Figure 13:
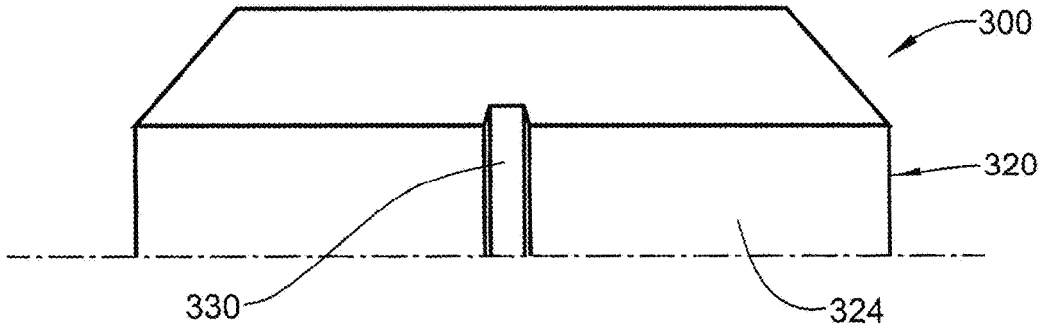
FIG. 13 depicts a packer formed from a material having an elastic structure, in accordance with another aspect of an exemplary embodiment.

In accordance with an aspect of an exemplary embodiment illustrated in FIG. 13, a packer 300 may include a body 320 formed from an elastic composite material 324. Body 320 may include an axially extending groove 330. Groove 330 may be receptive to a filler ring (not shown). Elastic composite material 324 may include one of a one-dimensional elastic structure, a periodic elastic structure, and a random elastic structure as described above. The elastic structure of elastic composite material 324 provides increased corrosion resistance resulting from corrosion resistant material and springs that may be formed from stainless steel. It is to be understood that packer 300 may be formed through a variety of processes including molding, extrusion, and the like.

In a manner similar to that described above, the elastic structure of elastic composite material 324 possess high extrusion resistance and thus is capable of holding or supporting pressures up to about 2000 psi (13.78 MPa) and greater. In a manner also similar to that described above, packer 300, may be deployed in high temperature conditions. In an example, packer 300 supports pressures of at least 2000 psi when exposed to temperatures that may exceed 450° F. (232° C.). The one-dimensional elastic structure of material 324 also possesses high expansion capabilities.

Further included in this disclosure are the following specific embodiments, which do not necessarily limit the claims.

Embodiment 1

A packer comprising: a body formed from an elastic composite material having one of a one-dimensional elastic structure, a periodic elastic structure, and a random elastic structure and a filler material.

Embodiment 2

The packer according to embodiment 1, wherein the filler material includes one or more of a carbon composite; a polymer; a metal; graphite; cotton; asbestos; and glass fibers.

Embodiment 3

The packer according to embodiment 2, wherein the filler material comprises a carbon composite having carbon microstructures including a plurality of interstitial spaces and a binder provided in one or more of the plurality of interstitial spaces.

Embodiment 4

The packer according to embodiment 3, wherein the binder is provided in between about 10% to about 90% of the plurality of interstitial spaces.

Embodiment 5

The packer according to embodiment 3, wherein the carbon microstructures have a size of between about 0.1 to about 100 microns.

Embodiment 6

The packer according to embodiment 1, wherein the filler material is one of a sintered material and a non-sintered material.

Embodiment 7

The packer according to embodiment 1, wherein the filler material comprises between about 20% to about 97.5% of the body.

Embodiment 8

The packer according to embodiment 1, wherein the body comprises a one-dimensional elastic structure including at least one of a solid tube, a solid rod a coating, a powder, a plurality of pellets.

Embodiment 9

The packer according to embodiment 1, wherein the one-dimensional elastic structure comprises a spring.

Embodiment 10

The packer according to embodiment 1, wherein the body formed from the elastic composite material having the periodic elastic structure.

Embodiment 11

The packer according to embodiment 1, wherein the body is supportable of pressures of at least 2000 psi (13.78 MPa) at temperatures exceeding 450° F. (232° C.).

Embodiment 12

A resource exploration/recovery system comprising: a surface portion; and a downhole portion including a plurality of tubulars, at least one of the plurality of tubulars including a packer comprising a body formed from an elastic composite material having one of a one-dimensional elastic structure, a periodic elastic structure, and a random elastic structure.

Embodiment 13

The resource exploration/recovery system according to embodiment 12, wherein the filler material includes one or more of a carbon composite; a polymer; a metal; graphite; cotton; asbestos; and glass fibers.

Embodiment 14

The resource exploration/recovery system according to embodiment 13, wherein the filler material comprises a carbon composite having carbon microstructures including a plurality of interstitial spaces and a binder provided in one or more of the plurality of interstitial spaces.

Embodiment 15

The resource exploration/recovery system according to embodiment 12, wherein the filler material is one of a sintered material and a non-sintered material.

Embodiment 16

The resource exploration/recovery system according to embodiment 12, wherein the body formed from the elastic composite material having the periodic elastic structure.

Embodiment 17

The resource exploration/recovery system according to embodiment 12, wherein the body is supportable of pressures of at least 2000 psi (13.78 MPa) at temperatures exceeding 450° F. (232° C.).

Embodiment 18

A method of segregating a borehole into multiple zones comprising: running a plurality of tubulars into the borehole; and deploying a packer comprising a body formed from an elastic composite material having one of a one-dimensional elastic structure, a periodic elastic structure, and a random elastic structure supported by one of the plurality of tubulars.

Embodiment 19

The method of embodiment 18, wherein deploying the packer includes expanding the packer at a portion of the borehole having a local temperature of at least 450° F. (232° C.).

Embodiment 20

The method of embodiment 18, further comprising: exposing the packer to a pressure of at least 2000 psi (13.78 MPA).

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The terms "about" and "substantially" unless otherwise defined are intended to include the degree of error associated with measurement of the particular quantity based upon the equipment available at the time of filing the application. For example, "about" and "substantially" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A packer comprising:

a body formed from an elastic composite material having one of a one-dimensional elastic structure, a periodic elastic structure, and a random elastic structure and a filler material.

2. The packer according to claim 1, wherein the filler material includes one or more of a carbon composite; a polymer; a metal; graphite; cotton; asbestos; and glass fibers.

3. The packer according to claim 2, wherein the filler material comprises a carbon composite having carbon microstructures including a plurality of interstitial spaces and a binder provided in one or more of the plurality of interstitial spaces.

4. The packer according to claim 3, wherein the binder is provided in between about 10% to about 90% of the plurality of interstitial spaces.

5. The packer according to claim 3, wherein the carbon microstructures have a size of between about 0.1 to about 100 microns.

6. The packer according to claim 1, wherein the filler material is one of a sintered material and a non-sintered material.

7. The packer according to claim 1, wherein the filler material comprises between about 20% to about 97.5% of the body.

8. The packer according to claim 1, wherein the body comprises a one-dimensional elastic structure including at least one of a solid tube, a solid rod, a coating, a powder, a plurality of pellets.

9. The packer according to claim 1, wherein the one-dimensional elastic structure comprises a spring.

10. The packer according to claim 1, wherein the body formed from the elastic composite material having the periodic elastic structure.

11. The packer according to claim 1, wherein the body is supportable of pressures of at least 2000 psi (13.78 MPa) at temperatures exceeding 450° F. (232° C.).

12. A resource exploration/recovery system comprising:

a surface system; and a downhole system including a plurality of tubulars, at least one of the plurality of tubulars including a packer comprising a body formed from an elastic composite material having one of a one-dimensional elastic structure, a periodic elastic structure, and a random elastic structure, and a filler material.

13. The resource exploration/recovery system according to claim 12, wherein the filler material includes one or more of a carbon composite; a polymer; a metal; graphite; cotton; asbestos; and glass fibers.

14. The resource exploration/recovery system according to claim 13, wherein the filler material comprises a carbon composite having carbon microstructures including a plurality of interstitial spaces and a binder provided in one or more of the plurality of interstitial spaces.

15. The resource exploration/recovery system according to claim 12, wherein the filler material is one of a sintered material and a non-sintered material.

16. The resource exploration/recovery system according to claim 12, wherein the body formed from the elastic composite material having the periodic elastic structure.

17. The resource exploration/recovery system according to claim 12, wherein the body is supportable of pressures of at least 2000 psi (13.78 MPa) at temperatures exceeding 450° F. (232° C.).

18. A method of segregating a borehole into multiple zones comprising:

running a plurality of tubulars into the borehole; and deploying a packer comprising a body formed from an elastic composite material having one of a one-dimensional elastic structure, a periodic elastic structure, and a random elastic structure supported by one of the plurality of tubulars.

19. The method of claim 18, wherein deploying the packer includes expanding the packer at a portion of the borehole having a local temperature of at least 450° F. (232° C.).

20. The method of claim 18, further comprising: exposing the packer to a pressure of at least 2000 psi (13.78 MPA).

* * * * *